US006394570B1

(12) United States Patent
Inada

(10) Patent No.: US 6,394,570 B1
(45) Date of Patent: May 28, 2002

(54) INK-JET RECORDING METHOD, INK-JET RECORDING APPARATUS AND INFORMATION PROCESSING SYSTEM

(75) Inventor: Genji Inada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/538,843

(22) Filed: Dec. 31, 1997

Related U.S. Application Data

(63) Continuation of application No. 08/361,440, filed on Dec. 21, 1994.

(30) Foreign Application Priority Data

Dec. 24, 1993 (JP) ..... 5-327838

(51) Int. Cl.[7] ..... B41J 2/205
(52) U.S. Cl. ..... 347/15
(58) Field of Search ..... 347/15.43; 358/298

(56) References Cited

U.S. PATENT DOCUMENTS 5,430,469 A 7/1995 Shioya et al.

FOREIGN PATENT DOCUMENTS

| | | |
|---|---|---|
| JP | 54-009928 | 1/1979 |
| JP | 55-139269 | 10/1980 |
| JP | 57-160654 | 10/1982 |
| JP | 59-207256 | 11/1984 |
| JP | 61-146552 | 7/1986 |
| JP | 61-146556 | 7/1986 |
| JP | 63-053052 | 3/1988 |
| JP | 3-2060 | 1/1991 |
| JP | 4-097880 | 3/1992 |
| JP | 4-133743 | 5/1992 |
| JP | 4-358847 | 12/1992 |

OTHER PUBLICATIONS

English Abstract of Japanese Patent Document No. 3–2060 dated Jan. 1991.

*Primary Examiner*—John Barlow
*Assistant Examiner*—Craig A. Hallacher
(74) *Attorney, Agent, or Firm*—Fitzpatrick, Cella, Harper & Scinto

(57) ABSTRACT

An ink-jet recording method includes a step of applying each of a plurality of ejection signals to an ejecting device. Each of the ejecting signals is generated in such a manner that at least one of a quantity of energy to be fed to the ejecting device per unit time and a total quantity of energy differs from the other one. It is preferable that when a plurality of ink droplets are shot onto a recording medium at the substantially same location on the latter, an ejection signal for allowing at least one of a quantity of energy to be fed to the ejecting device and a total quantity of energy to be maximized is selected from a plurality of ejection signals, and subsequently, it is applied to the ejecting device.

18 Claims, 10 Drawing Sheets

FIG.12A NOZZLE Ni

FIG.12D NOZZLE Ni+1

INK-JET RECORDING METHOD, INK-JET RECORDING APPARATUS AND INFORMATION PROCESSING SYSTEM

This application is a continuation of application Ser. No. 08/361,440, filed Dec. 21, 1994, now abandoned.

BACKGROUND OF THE INVENTION

1. Field of the Invention

The present invention relates to an ink-jet recording method for recording input data such as characters, images, and pictures on a recording medium. Also, the present invention relates to an ink-jet recording apparatus using an ink-jet recording head for performing such method. Further, the present invention relates to an information-processing system comprising the ink-jet recording apparatus as an output device, such as a copying machine, a facsimile, a printer, a word processor, and a personal computer.

Here, it should be construed that a term "recording" involves a technical concept of applying ink to all kinds of ink receiving articles such as cloth, thread, paper, and sheet-like materials each adapted to receive ink from the ink-jet recording head (in the form of printing, image forming, dyeing or the like), and that the present invention can be applied not only to a field of information processing but also to a various kind of industrial field (for example, an apparel industry) by using the ink receiving article mentioned above.

2. Description of the Related Art

Many proposals have been hitherto made with respect to a recording apparatus for performing a recording operation on a recording medium such as paper, cloth, plastic sheet, and OHP sheet (hereinafter referred to generally as a recording paper) with the aid of a recording head mounted on the recording apparatus so as to operate in accordance with various kinds of recording methods such as a wire dot recording method, a heat susceptible recording method, a thermal transfer recording method, and an ink-jet recording method.

Among the aforementioned recording methods, the ink-jet recording method belongs to a no-impact recording method of ejecting ink from an ink-jet recording head so as to allow the ink to adhere directly to a recording paper, and it is generally classified into two types, one of them being a continuous type (inclusive of an electric charge particle controlling type and a spraying type) and the other one being an on-demand type (inclusive of a piezo type, a sparking type and a bubble jet type).

The continuous type ink-jet recording method is practiced such that ink is continuously ejected to a recording paper from an ink-jet recording head and electric charge is applied only to necessary ink droplets among a number of ejected ink droplets. Thus, the electrically charged ink droplets adhere to the recording paper but the remaining ones are uselessly wasted.

On the contrary, the on-demand type ink-jet recording method is practiced such that ink is ejected from an ink-jet recording head only when ink ejection is required for performing a recording operation. Thus, the on-demand type process does not cause the trouble of uselessly ejecting ink from the ink-jet recording head to contaminate the interior of a recording apparatus with ink droplets. In addition, with respect to the on-demand type ink-jet recording method, each recording operation is controlled so as to perform repeatedly starting and stopping ink ejection and it can be achieved at a high speed by increasing the number of ink ejecting nozzles.

Many of recording apparatuses commercially sold at present are constructed in accordance with the on-demand type ink-jet recording method. Since a recording apparatus including an ink-jet recording head of the foregoing type makes it possible to perform a recording operation not only at a high density but also at a high speed, it is utilized and commercialized as outputting means for an information processing system, e.g., a printer serving as an output terminal unit for a copying machine, a facsimile, an electronic typewriter, a word processor, a work station or the like or a handy or portable type printer to be equipped in a personal computer, a host computer, an optical disc unit, a video unit or the like. In the circumstances as mentioned above, an ink-jet recording apparatus is constructed in such a manner as to match with a function and a type of practical use inherent to each of the aforementioned units.

In general, the ink-jet recording apparatus includes a carriage having recording means (ink-jet recording head) and an ink tank mounted thereon, conveying means for conveying a recording paper and controlling means for controlling the carriage and the conveying means. As ink is ejected from a plurality of ink ejecting nozzles on the ink-jet recording head in the form of ink droplets, serial scanning is performed in the direction (main scanning direction) orienting at a right angle relative to the conveying direction of the recording paper (auxiliary scanning direction). Subsequently, the recording paper is intermittently conveyed by a quantity equal to a recording width during the inoperative state of the ink-jet recording apparatus having no recording operation performed therewith. In response to a recording signal, the ink-jet recording apparatus performs a recording operation by ejecting ink onto the recording paper.

On the other hand, an ink-jet recording method to be practiced in association with the ink-jet recording apparatus is widely used as a quiet recording method capable of being employed at a low running cost. Since a plurality of ink ejecting nozzles are disposed along a straight line extending in the auxiliary scanning direction on the ink-jet recording head, each recording operation is achieved with a width corresponding to the number of ink ejecting nozzles every time the ink-jet recording head performs scanning over the recording paper. Consequently, the ink-jet recording method makes it possible to achieve a recording apparatus at a high speed.

In the case of a color ink-jet recording apparatus for printing in two or more colors, a multicolor image is formed by allowing ink droplets to overlap one above another on a recording paper by ejecting inks of several colors from a plurality of color ink-jet recording heads each including a plurality of ink ejecting nozzles. Generally, in the case that a color recording operation is performed with the color ink-jet recording apparatus, three or four ink-jet recording heads and three or four ink cartridges corresponding to three primary colors composed of yellow (Y), magenta (M) and cyan (C) or four colors composed of three primary colors and black (B). Lately, a color ink-jet recording apparatus having three or four kinds of color ink-jet recording heads mounted thereon so as to enable an image to be formed with full color has been put in practical use.

In addition, the foregoing type of color ink-jet recording apparatus can be constructed in such a manner as to enable an image to be comparatively easily recorded on a recording medium with a size of "A-1". Concretely, a color ink-jet recording apparatus electrically connected to a reader adapted to read an A-1 sized original of multicolor image so as to allow the original to be recorded on a recording paper, e.g., a plotter serving as a CAD output printer has been commercialized. On the other hand, it is practically required that the color ink-jet recording apparatus can be used in a variety of fashions, and lately, requests have been increasingly raised from users for providing a color ink-jet recording apparatus capable of recording various kinds of information such as characters, graphs, pictures, and figures on an OHP film in order to visually project the information on a screen for the presentation in a conference or lecture. To satisfactorily meet these requests, a number of development works have been conducted to commercialize an ink-jet recording apparatus capable of performing an optimum recording operation regardless of the kind of recording paper employed when a recording medium having properties of absorbing ink is selected as desired.

In addition, many requests have been raised from wide industrial fields (e.g., apparel industry) for providing an ink-jet recording apparatus of the foregoing type serving as excellent recording means for recording a higher quality of image on a recording medium.

Next, description will be made below with respect to an ink-jet recording head (hereinafter referred to simply as a recording head) to be mounted on an ink-jet recording apparatus.

Energy generating means disposed in the recording head for generating energy required for ejecting ink from the recording head is exemplified by an electromechanical transducer (such as a piezo element) and an electrothermal transducer including a heat generating resistor for the purpose of heating liquid.

With respect to a recording head of the type (i.e., a so-called bubble jet type) of ejecting liquid therefrom by utilizing thermal energy, i.e., by utilizing a phenomenon of film boiling (so-called bubble jet type recording head), since a plurality of liquid ejecting nozzles can be disposed at a high density, it is possible to perform a recording operation with a high level of resolution.

To facilitate understanding of the present invention, a conventional ink-jet recording head and a conventional ink-jet recording apparatus having the conventional ink-jet recording head mounted thereon will be described below with reference to FIG. 1 and FIG. 2.

FIG. 1 shows by way of schematic perspective sectional view the structure of an ink-jet recording head to be mounted on an ink-jet recording apparatus.

Reference numeral 91 designates a ceiling plate. A plurality of grooves 93 each serving as a nozzle for allowing ink to flow therethrough, a groove 94 communicated with the grooves 93 to serve as a common liquid chamber, and an ink feeding port 95 for feeding ink to the common liquid chamber therethrough are formed on the ceiling plate 1. Reference numeral 92 designates a base plate which is formed integral with a plurality of electrothermal transducers 96 serving corresponding to respective ink ejecting nozzles and a plurality of electrodes 97 for feeding electricity to the respective electrothermal transducers 96 by employing a film forming technology. A plurality of ink ejecting ports 98 (orifices) for ejecting ink therefrom are formed in combination of the ceiling plate 91 with the base plate 92.

The recording head constructed in the manner as described above is integrated with an ink tank for feeding ink thereto through the ink feeding port 95 to constitute an ink-jet cartridge.

FIG. 2 shows by way of schematic perspective view the structure of an ink-jet recording apparatus having the ink-jet recording head shown in FIG. 1 mounted thereon.

In the drawing, reference numeral 120 designates an ink-jet recording head (recording head) for an ink-jet cartridge IJC which includes a group of ink ejecting nozzles facing to the recording surface of a recording paper conveyed onto a platen 124. Reference numeral 116 designates a carriage HC for holding the recording head 120 thereon. The carriage HC is fastened to part of a driving belt 118 which transmits thereto the driving force generated by a driving motor 117. The carriage HC can reciprocably be displaced across the whole width of the recording paper with the aid of two guide shafts 119A and 119B extending in parallel with each other. As data are received by the recording head 120, images are recorded on the recording paper corresponding to the received data during the reciprocable displacement of the recording head 120. The recording paper is conveyed by a predetermined distance on completion of each main scanning, and subsequently, auxiliary scanning is performed with the recording head 120.

Reference numeral 126 designates a head recovering unit which is arranged at the position facing to one end of the path of displacement of the recording head 120, e.g., the position located opposite to a home position of the recording head 120. As the driving force generated by a motor 122 is transmitted via a power transmitting mechanism 123, the head recovering unit 126 is activated, causing the recording head 120 to be capped with a cap portion 126A. Subsequently, ink is sucked (to attain suction recovery) by driving adequate sucking means (e.g., suction pump) disposed in the head recovering unit 126 in operative association with the capping portion 126A of the head recovering unit 126, whereby ink located in the ink ejecting ports of the recording head 120 with increased viscosity is forcibly discharged from the ink ejecting ports, resulting in the recording head 120 being subjected to ink discharge recovering treatment. In addition, the recording head 120 is protected from an occurrence of malfunctions by allowing the recording head 120 to be capped with the capping portion 126A after completion of each recording operation. Such ink discharge recovering treatment as mentioned above is executed when a power source is turned on or when the recording head 120 is replaced with a new one or when no recording operation is performed for a period of time longer than a predetermined one.

Reference numeral 131 designates a blade molded of a silicone rubber. The blade 131 is disposed on the right-hand side surface of the head recovering unit 126 to serve as a wiping member while it is held by a blade holding member 131A in the cantilever-like fashion. Similar to the head recovering unit 126, the blade 131 is actuated by the motor 122 and the power transmitting mechanism 123 until it is engaged with an ink ejecting plane of the recording head 120. The blade 131 is projected in the path of displacement of the recording head 120 at a certain adequate timing during each recording operation performed by the recording head 120 or after the ink discharge recovering treatment conducted by the head recovering unit 126, whereby dew, moisture or dust particle on the ink ejecting plane of the recording head 120 is wiped off by the blade 131 as the recording head 120 is displaced in the leftward/rightward direction.

Next, a plurality of steps of forming ink droplets in accordance with the bubble jet recording method to be practiced by the recording head constructed in that way will be described below.

Specifically, when a heat generating resistance (heater) is heated to reach a predetermined elevated temperature, a film-like gas bubble is formed in such a manner as to cover the heater surface with the gas bubble. Since an intensity of pressure in the gas bubble is very high, ink in each nozzle is squeezed outside of a nozzle. Then, ink is displaced not only outside of the nozzle but also toward the common liquid chamber located opposite to the nozzle under the influence of the inertia force induced by the squeezing of ink. As ink is increasingly displaced, the pressure in the gas bubble becomes negative. Since the resistance against the flowing of ink in the liquid flow passage is additionally applied to the negative pressure, the speed of ink displacement in the nozzle is reduced. On the other hand, ink discharged outside of a nozzle (orifice) is displaced at a speed higher than that of ink in the nozzle, causing a necked part to appear on the gas bubble attributable to the balance established among the inertia force, the resistance against the flowing of ink through the liquid flow passage, the contraction of the gas bubble and the surface tension of ink. A part of ink in the nozzle is separated away from the nozzle in the presence of the necked part of the gas bubble, and thereafter, it is transformed into an ink droplet. Subsequently, as the gas bubble is contracted, ink is fed to the nozzle from the common liquid chamber by the capillary force. At this time, the recording head is ready to receive a next pulse.

In such manner, the recording head having a plurality of electrothermal transducers used as energy generating means assures that in response to a pulse-like signal induced by a driving current, a gas bubble can be generated in ink in the liquid passage in the one-to-one relationship, and moreover, the gas bubble can instantaneously and adequately be grown and contracted, whereby an ink droplet can be discharged from the recording head especially with excellent responsiveness. In addition, the recording head can easily be designed and constructed with remarkably reduced dimensions, and since advantages derived from the integral circuit technology and the micro-machining technology remarkably advanced and improved in reliability in recent years can sufficiently be utilized for the recording head, a plurality of recording heads can easily be mounted on an ink-jet recording apparatus while each recording head is fabricated at an inexpensive cost.

Next, the method of determining a gray level based on the conventional ink-jet recording apparatus constructed in the above-described manner is exemplified by a method of allowing one pixel representing an image signal to correspond to one pixel representing binary recording and then expressing a gray level by binarizing the thus corresponding pixel with reference to a predetermined threshold value (dither method), a method of changing a magnitude of each dot by forming a composite liquid droplet composed of a plurality of liquid droplets and then shooting it onto a recording medium as disclosed in official gazettes of Japanese Patent Application Laying-open Nos. 207256/1984, 160654/1982 and 53052/1988 (liquid droplet modulating method) and a method of forming one bit by shooting a plurality of liquid droplets onto a recording medium at a same location on the latter to form one dot therewith and then determining a gray level depending on the number of liquid droplets shot onto the recording medium as disclosed in an official gazette of Japanese Patent Application Laying-open No. 53052/1988 (multi-droplet method). Among them, the dither method has a drawback that a level of image resolution is increasingly reduced, and the liquid droplet modulating method has a drawback that a wide gray level width is hardly determined within the practical range defined by a distance between a recording apparatus and a recording paper. On the contrary, the multi-droplet method has an excellent advantage that each recording operation can be achieved not only at a high gray level but also with a high level of resolution by selectively using an ink-jet recording head adapted to eject a number of small liquid droplets therefrom.

Generally, a period of time of several hundred milliseconds are taken until ink penetrates into a recording medium after liquid droplets are shot onto the recording medium. When a preceding liquid droplet is shot onto the recording medium, a semisphere liquid droplet is formed on the recording medium. Thus, as subsequent liquid droplets are successively shot onto the preceding liquid droplet on the recording medium in the overlapping state, a larger semispherical liquid droplet can be formed on the recording medium, and it is possible to control a size of each pixel by changing the number of liquid droplets overlapping one above another.

Although it is anticipated that a recording speed is undesirably reduced when the number of liquid droplets to overlap one above another is increased to attain a wide gray level width, this problem can be solved by combining the aforementioned liquid droplet modulating method with a method of shooting liquid droplets each having a different volume ejected from different nozzles on a recording medium in the overlapping state for a very short period of time with the aid of an ink-jet recording head as disclosed in an official gazette of Japanese Patent Application Publication No. 502261/1988.

FIG. 3 and FIG. 4 illustratively show a series of steps of forming a pixel in accordance with the multi-drop process, respectively. This process is intended to form one pixel by shooting a plurality of liquid droplets on a recording medium at the substantially same location of the latter in the overlapping state. In this case, the pixel formed by one liquid droplet may be taken as one pixel. In FIG. 4, a pixel frequency fo determines a minimum distance between adjacent pixels on the recording medium as measured in the main scanning direction of the ink-jet recording head. In addition, a liquid droplet ejection frequency fo determines the number of ink droplets shot onto the recording paper at the substantially same location on the latter.

Referring to FIG. 3 and FIG. 4, an ejection signal P21 is applied to ejecting means disposed in a nozzle of the ink-jet recording head to eject a liquid droplet D1 from the nozzle. After a period of 1/f elapses, a liquid droplet D2 is ejected on a pixel 101 formed with the liquid droplet D1 on a recording medium 103 in response to a selective ejection signal P22 in such a manner that at least a part of the liquid droplet D2 overlaps on the pixel 101. Similarly, in response to ejection signals P23 and P24, liquid droplets D3 and D4 are ejected from the nozzle, causing the formation of a pixel 102 to be completed. A size of each pixel on the recording medium can be changed to another one in the course of the aforementioned steps depending on whether the ejection signals P21, P22, P23 and P24 are applied to the ejecting means or not. In the case that a different pixel is formed adjacent to the pixel 102, it is sufficient that an ejection signal P21' is applied to the ejecting means after a period of 1/fo counted from the application of the ejection signal P21 to the ejecting means elapses.

Granularity of a high light part on a multi-valued image can be noted as a factor having significant effect on a quality of multi-valued image. Especially, in the case that a pixel formed with one liquid droplet has a large size, the foregoing granularity can remarkably visually be recognized by anyone, resulting in a quality of image being deteriorated. To assure that the deterioration of the quality of image can be prevented by reducing an extent of granularity, it is necessary that each pixel is formed with smaller liquid droplets. For example, an examination conducted by the inventor of the present invention reveals that when an image colored with black is observed at a location remote from the image by a distance of about 25 cm or more, the quality of image is not greatly deteriorated irrespective of the observer's sense affected by the granularity of image, as long as an average diameter of each pixel on the recording medium remains within the range of 5 to 50 $\mu$m. In addition, when each pixel has an average diameter of 30 $\mu$m or less, the deterioration of the quality of image is negligibly small.

However, if the high light part of an image on the recording medium is formed only with liquid droplets each having such a size that the granularity of image is not remarkably recognized by anyone, one pixel is formed with a larger number of liquid droplets when a high density part on an image is formed with liquid droplets. For example, when an image is formed with liquid droplets each having a volume of 10 pl, the granularity of a high light part on the image is less visually recognized than the case that liquid droplets each having a volume of 20 pl are used for forming the image. However, to assure that an image is formed at a substantially same density, the number of liquid droplets as many as two times of the number of liquid droplets each having a volume of 10 pl are required. In addition, to maintain an image output time in the case that liquid droplets each having a volume of 20 pl are used, liquid droplets each having a volume of 10 pl should be ejected from the ink-jet recording head at a frequency as high as about two times. Generally, when a volume of each liquid droplet ejected from the ink-jet recording head is reduced to a level of 10 pl or less, it is not easy to substantially improve a time to be taken until an ink meniscus in each nozzle is restored to the position prior to ink ejection after ink is ejected from the nozzle (hereinafter referred to as a refill time), merely by modifying the structure of the nozzle to some extent. In the case that a liquid droplet is ejected from each nozzle before the meniscus is restored to the foregoing position, it is difficult to maintain stable ink ejection.

To cope with the foregoing problems, it is thinkable that a measure is selectively taken such that a multi-valued image having a high quality is obtained by using an ink-jet recording head adapted to successively eject a number of small liquid droplets therefrom to form a pixel in such a manner that granularity of the pixel is not clearly recognized by anyone although an image output speed is slow to some extent. With this ink-jet recording head constructed in that way, however, there sometimes arises an occasion that viscosity of ink remaining in each nozzle is increased due to evaporation of volatile components in ink with the result that incorrect ink ejection such as deformation of a recorded image, failure of ink ejection or the like occurs due to the reduction of a liquid droplet ejection speed. This tendency is remarkably recognized more and more in the case that an ink-jet recording head having a small nozzle size and a small orifice area is employed for an ink-jet recording apparatus in order to obtain small liquid droplets. Therefore, to assure that a high quality of multi-valued image is obtained by successively ejecting a number of small liquid droplets from the ink-jet recording head in such a manner that granularity of a pixel is not visually clearly recognized by anyone, it is inevitable to take a measure against a mode of incorrect ink ejection.

To solve the foregoing problem, a proposal has been made with respect to a so-called preliminary ink ejection sequence for allowing liquid droplets unusable for each recording operation to be ejected from an ink-jet recording head during the standby state or during the recording operation. For example, the preliminary ejection sequence is exemplified by a method of executing preliminary ink ejection by displacing the ink-jet recording head to a predetermined position located outside of the recording range (as disclosed in an official gazette of Japanese Patent Application Laying-open No. 9928/1979) and a method of executing preliminary dispersive ink ejection for a recording medium after each elapse of a predetermined time period (as disclosed in an official gazette of Japanese Patent Application Laying-open No. 139269/1980). As a concrete method of executing preliminary ejection with a thermal ink-jet recording head, the applicant common to the present invention has already proposed a method of executing preliminary heating with the aid of a heater at the same time as preliminary ink ejection is executed (as disclosed in an official gazette of Japanese Patent Application Laying-open No. 146552/1986) and a method of executing preliminary ink ejection with a larger quantity of energy than that required during each recording operation (as disclosed in an official gazette of Japanese Patent Application Laying-open No. 146556/1986)

However, when each of the prior methods as disclosed in official gazettes of Japanese Patent Application Laying-open Nos. 9928/1979, 146552/1986 and 146556/1986 is employed for an ink-jet recording head, an image output speed is additionally reduced as the ink-jet recording head is displaced to a predetermined position located outside of the recording range. For this reason, it can not be concluded that each of the aforementioned prior methods is a preferable method. Generally, about 10 to 1000 liquid droplets are ejected from each nozzle every time preliminary ink ejection is executed in order to obtain desired advantageous effects. However, in the case that the method as disclosed in an official gazette of Japanese Patent Application Laying-open No. 139269/1980 is employed for executing preliminary dispersive ink ejection, there appears a drawback that granularity on an image is not visually recognized at the high light part of the image but it is liable to be remarkably visually recognized as color contamination.

SUMMARY OF THE INVENTION

The present invention has been made in consideration of the aforementioned problems to be solved.

An object of the present invention is to provide an ink-jet recording method which assures that deterioration of a quality of image can be prevented, and moreover, each recording operation can be achieved with a high quality.

Another object of the present invention is to provide an ink-jet recording apparatus for practicing an ink-jet recording method of the foregoing type.

A further object of the present invention is to provide an information processing system including an ink-jet recording apparatus of the foregoing type as. outputting means.

In a first aspect of the present invention, there is provided an ink-jet recording method of forming one pixel by ejecting a plurality of ink droplets onto a recording medium at the substantially same location on the latter using an ink-jet recording head including ejecting means for ejecting ink droplets therefrom, the ejecting of the ink droplets from the ink-jet recording head being performed in response to a plurality of ejection signals fed to the ink-jet recording head, wherein the plurality of ejection signals are generated in such a manner that at least one of a quantity of energy to be fed to the ejecting means per unit time and a total quantity of energy differs from the other one.

Here, the plurality of ink droplets may be ejected onto the recording medium at the substantially same location on the recording medium, an ejection signal for allowing at least one of a quantity of energy to be fed to the ejecting means per unit time and a total quantity of energy to be maximized is selected from the plurality of ejection signals, and subsequently, it is applied to the ejecting means.

The plurality of ink droplets may be shot onto the recording medium at the substantially same location of the recording medium, a preliminary signal for allowing no ink droplet to be ejected from the ejecting means is applied to the ejecting means.

One pixel may be formed by ejecting the plurality of ink droplets onto the recording medium at the substantially same location on the recording medium, the pixel is formed by the ejection of liquid droplets executed by performing scanning plural times.

The ejecting method may be an electrothermal transducer for generating thermal energy required for allowing a phenomenon of film boiling to appear in ink in order to eject ink therefrom.

In a second aspect of the present invention, there is provided an ink-jet recording apparatus including a carriage for displacing an ink-jet recording head in the main scanning direction while the ink-jet recording head is mounted thereon, the ink-jet recording head including ejecting means for ejecting ink droplets onto a recording medium so as to allow input image information to be recorded on the recording medium, a driving unit for feeding a plurality of ejection signals to the ink-jet recording head when the ink droplets are ejected from the ink- jet recording head and a controlling unit for controlling operations of the carriage, the ink-jet recording head, and the driving unit in order to form one pixel by ejecting a plurality of ink droplets on the recording medium at the substantially same location on the recording medium, in response to the plurality of ejection signals, wherein the controlling unit serves to generate the plurality of ejection signals in such a manner that at least one of a quantity of energy to be fed to the ejecting means per unit time and a total quantity of energy differs from the other one.

When the plurality of liquid droplets may be shot onto the recording medium at the substantially same location of the recording medium, an ejection signal for allowing at least one of a quantity of energy to be fed to the ejecting means per unit time and a total quantity of energy to be maximized is selected from the plurality of ejection signals, and subsequently, it is applied to the ejecting means.

Before the plurality of ink droplets may be shot onto the recording medium at the substantially same location on the recording medium, a preliminary signal for allowing no ink droplet to be ejected from the ejecting means is applied to the ejecting means.

When one pixel may be formed by ejecting the plurality of ink droplets onto the recording medium at the substantially same location on the recording medium, the pixel is formed by the ejection of liquid droplets executed by performing scanning plural times.

The ejecting means may be an electrothermal transducer for generating thermal energy required for allowing a phenomenon of film boiling to appear in ink in order to eject ink therefrom.

The apparatus may be utilized as a printer serving as an output terminal unit for a copying machine, a facsimile, an electronic typewriter, a word processor, a work station and so forth or a handy or portable printer to be equipped in a personal computer, a host computer, an optical disc unit, a video unit and so forth.

In a third aspect of the present invention, there is provided an information processing system including an ink-jet recording apparatus as outputting means, the ink-jet recording apparatus including a carriage for displacing an ink-jet recording head in the main scanning direction while the ink-jet recording head is mounted thereon, the ink-jet recording head including ejecting means for ejecting ink droplets onto a recording medium so as to allow input image information to be recorded on the recording medium, a driving unit for feeding a plurality of ejection signals to the ink-jet recording head when the ink droplets are ejected from the ink-jet recording head, and a controlling unit for controlling operations of the carriage, the ink-jet recording head and the driving unit in order to form one pixel by ejecting a plurality of ink droplets onto the recording medium at the substantially same location on the recording medium, in response to the plurality of ejection signals, wherein the controlling unit serves to generate the plurality of ejection signals in such a manner that at least one of a quantity of energy to be fed to the ejecting means per unit time and a total quantity of energy differs from the other one.

When the plurality of liquid droplets may be shot onto the recording medium at the substantially same location of the recording medium, an ejection signal for allowing at least one of a quantity of energy to be fed to the ejecting means per unit time and a total quantity of energy to be maximized is selected from the plurality of ejection signals, and subsequently, it is applied to the ejecting means.

Before the plurality of ink droplets may be shot onto the recording medium at the substantially same location on the recording medium, a preliminary signal for allowing no ink droplet to be ejected from the ejecting means is applied to the ejecting means.

When one pixel may be formed by ejecting the plurality of ink droplets onto the recording medium at the substantially same location on the recording medium, the pixel is formed by the ejection of liquid droplets executed by performing scanning plural times.

The ejecting means may be an electrothermal transducer for generating thermal energy required for allowing a phenomenon of film boiling to appear in ink in order to eject ink therefrom.

The information processing system may be an information processing system which is selected from a group consisting of a copying machine, a facsimile, an electronic typewriter, a word processor, a work station, a personal computer, a host computer, an optical disc unit and a video unit.

The above and other objects, effects, features and advantages of the present invention will become apparent from reading of the following description on preferred embodiments thereof in conjunction with the accompanying drawings.

BRIEF DESCRIPTION OF THE DRAWINGS

FIGS. 12A–12F comprise an illustrative view similar to FIGS. 7A–7F explaining a plurality of ejection signals to be applied to the ink-jet recording head by practicing an ink-jet recording method in accordance with another embodiment of the present invention.

DESCRIPTION OF PREFERRED EMBODIMENTS

Figure 1:
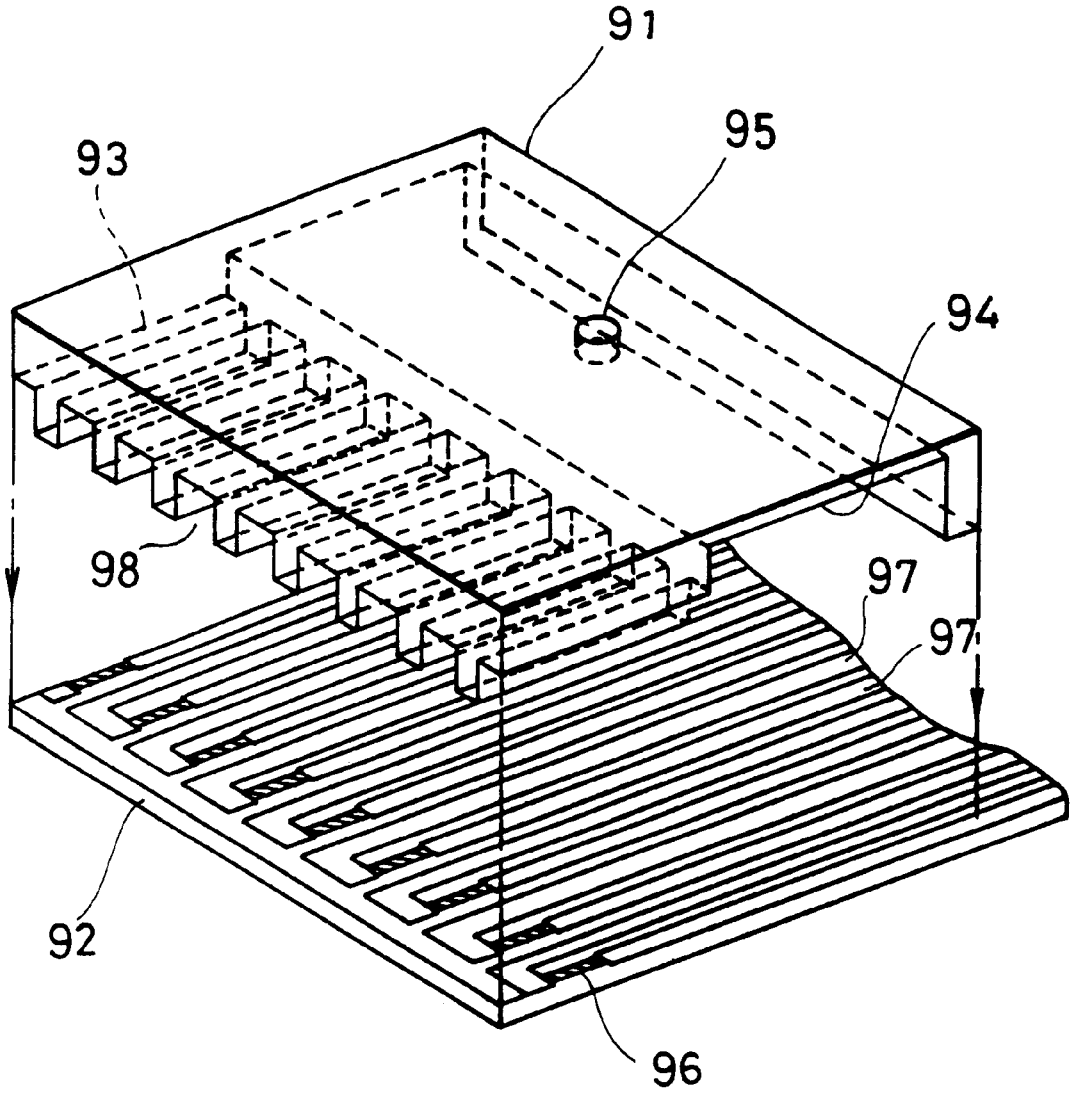
FIG. 1 is a perspective view which illustratively shows the schematic structure of a conventional ink-jet recording head.
Figure 2:
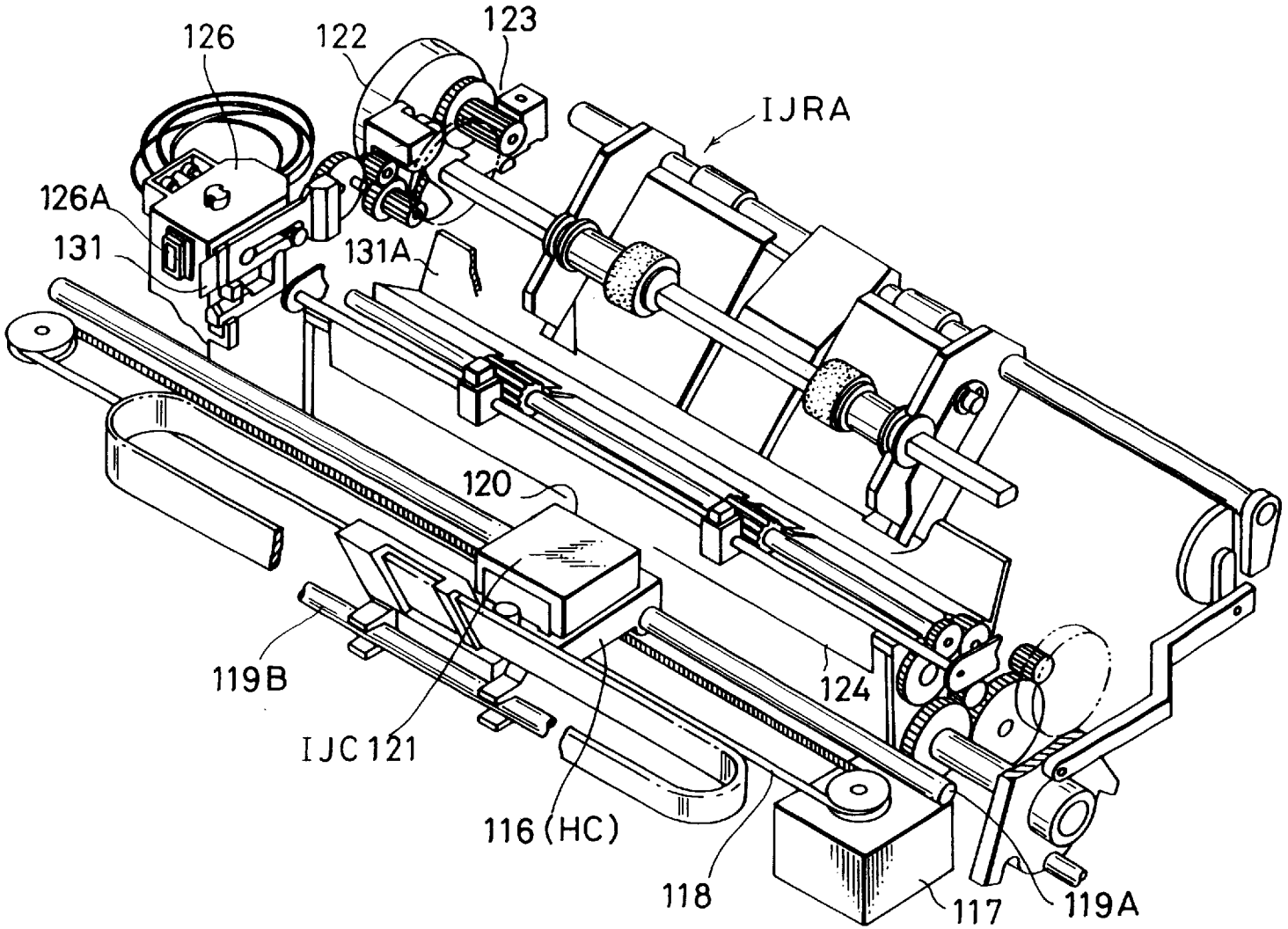
FIG. 2 is a perspective view which illustratively shows the schematic structure of a conventional ink-jet recording apparatus.

The present invention will now be described in detail hereinafter with reference to the accompanying drawings which illustrate preferred embodiments thereof. It should be noted that the schematic structure of an ink-jet recording apparatus to which the present invention is applied is coincident with that of the conventional ink-jet recording apparatus described above with reference to FIG. 1 and FIG. 2.

Generally, in response to an ejection signal applied to an ink-jet recording head, a plurality of secondary liquid droplets (satellite liquid droplets) are ejected from the ink-jet recording head together with a main liquid droplet, and these liquid droplets are normally shot onto the recording medium (recording paper) at the substantially same location of the recording medium to form one pixel therewith. In view of the foregoing fact, the following description will be made on the assumption that one liquid droplet is expressed by combination of the main liquid droplet with the satellite liquid droplets. In addition, it is assumed that in response to one ejection signal applied to the ink-jet recording head, one liquid droplet is ejected from the ink-jet recording head.

(Embodiment 1)

Figure 5:
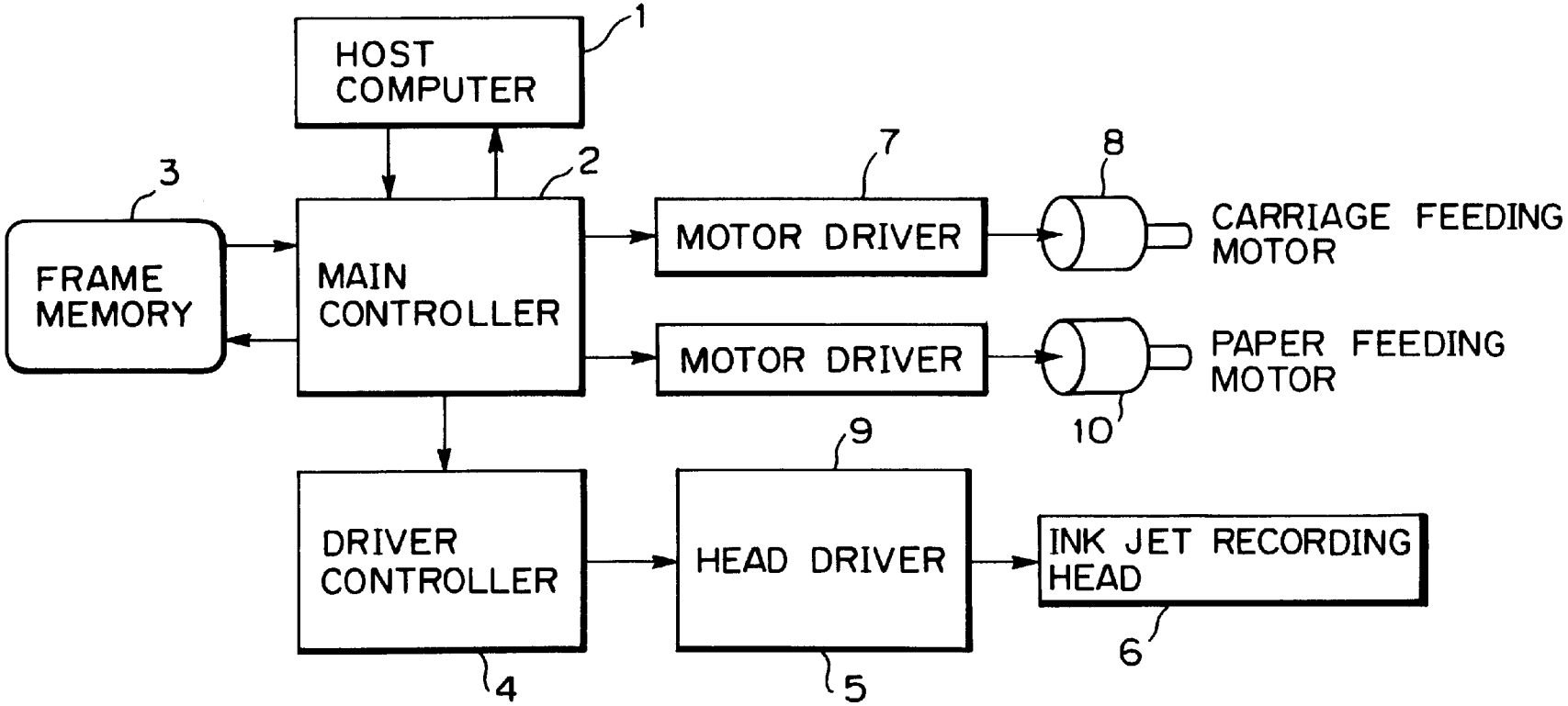
FIG. 5 is a block diagram which explains the schematic structure of a controlling system for an ink-jet recording apparatus for which an ink-jet recording method is practiced in accordance with the present invention.

FIG. 5 is a block diagram which illustratively shows the schematic structure of essential components arranged in a controlling system for an ink-jet recording apparatus for which an ink-jet recording method is practiced in accordance with an embodiment of the present invention. A main controller 2 receives pixel data signals which correspond to each of ink colors from a host computer 1, and subsequently, pixel data are stored in a buffer frame memory 3 with one frame as a unit. While a recording operation is performed, the main controller 2 controls the driving of a carriage feeding motor 8 via a motor driver 7, and moreover, it controls the driving of a paper feeding motor 10 via a motor driver 9. In addition, the main controller 2 controls the ejection of ink from an ink-jet recording head 6 in the predetermined timing relationship via a driver controller 4 and a head driver 5 based on the image data read from the frame memory 3 with respect to each of the ink colors, whereby a recording operation is achieved with a high quality of image.

Figure 3A:
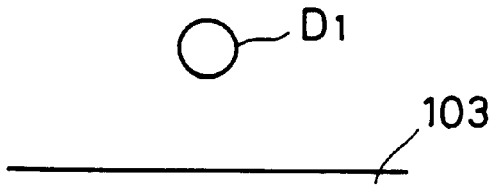
FIG. 3A to FIG. 3E are schematic views which explain a series of steps of forming a pixel using the conventional ink-jet recording head, respectively.
Figure 3B:
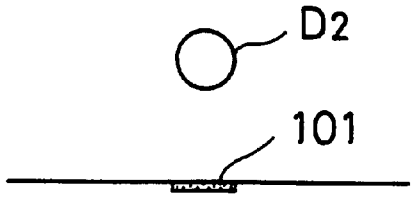
Figure 3C:
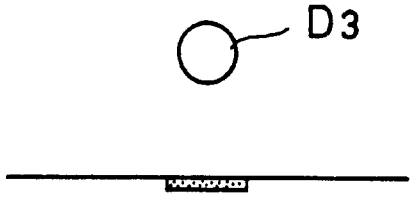
Figure 3D:
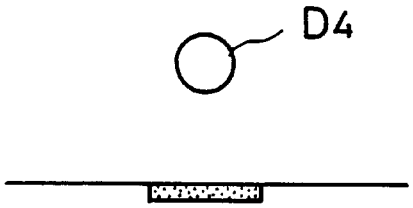
Figure 3E:
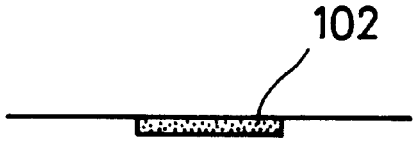
Figure 4:
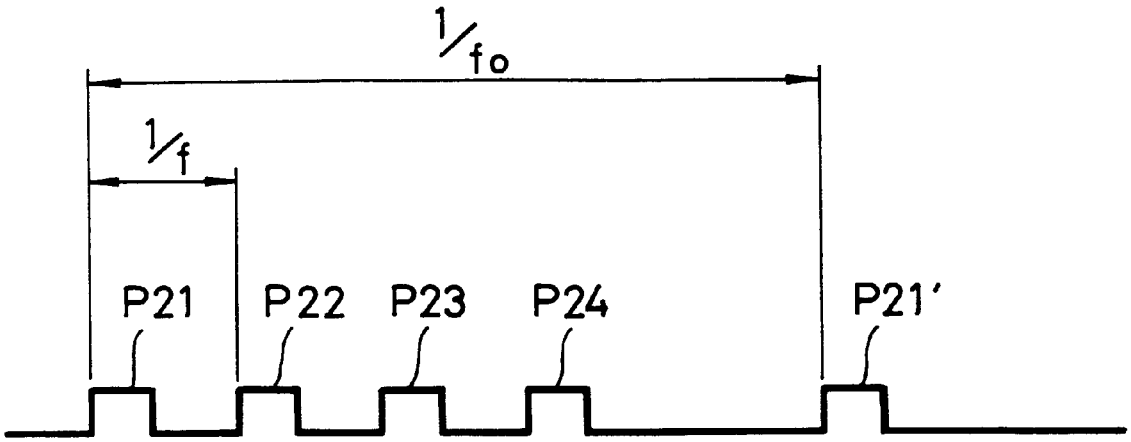
FIG. 4 is an illustrative view which explains a process of applying an ejection signal to the ink-jet recording head in association with a conventional ink-jet recording method.

In this embodiment, it is assumed that a first liquid droplet required for forming one pixel like the liquid droplet D1 shown in FIG. 3A is called "NO. 1 liquid droplet", a second liquid droplet like the liquid droplet D2 shown in FIG. 3B is called "NO. 2 liquid droplet", and a liquid droplet shot onto a recording paper at the substantially same location of the recording medium in the overlapping state for forming one pixel at an i-th timing is called "NO. i liquid droplet". In addition, it is assumed that one pixel formed by i liquid droplets as counted till an i-th liquid droplet is called "NO. i pixel".

Figure 6A:
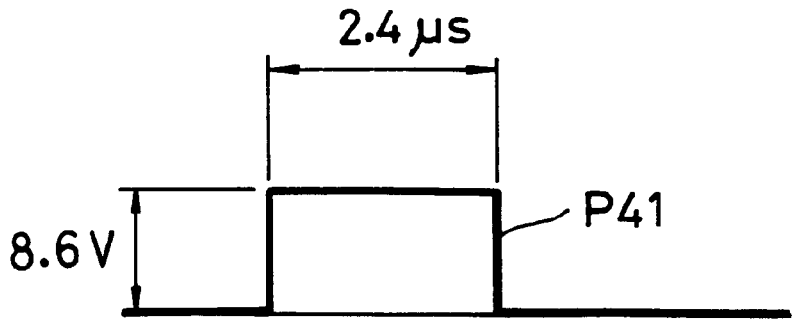
FIG. 6A is an illustrative view which explains an ejection signal to be applied to an ink-jet recording head by practicing an ink-jet recording method in accordance with an embodiment of the present invention.

The ink-jet recording head used in this embodiment was such that an orifice area was 150 $\mu m^2$ and a heater area was 400 $\mu m^2$, and in the case that ink having the following composition (Table 1) was ejected from the ink-jet recording head in response to an ejection signal P41 (having an applied voltage of 8.6V and a pulse width of 2.4 $\mu$m) as shown in FIG. 6A, an average volume of one liquid droplet was about 2.5 pl.

TABLE 1

| composition of ink | |
|---|---|
| dyestuff (CI, FB2) | 3.0 % by weight |
| diethylene glycol | 30.0 % by weight |
| ethanol | 3.0 % by weight |

When Color Bubble Jet Copier 1 Paper (sold under the trademark assigned to Canon Corp.) was selected as a recording paper, it was found that an average area of one pixel was about 40 $\mu m^2$ and deterioration of a quality of image due to granularity on the pixel was negligibly small. In addition, when a pixel was formed at a pixel density of 400 dpi by allowing liquid droplets to overlap one above another, a reflection density of 1.45 to 1.5 could be obtained by a pattern having fifteen pixels arranged thereon. Here, it should be added that the reflection density was measured by using Machbeth RD918 (Trademark).

Next, this embodiment will concretely be described below with respect to the case that one pixel is formed with no more than fifteen liquid droplets.

Figure 6B:
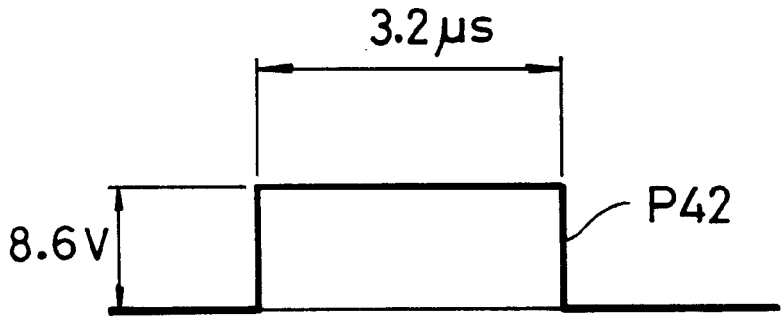
FIG. 6B is an illustrative view similar to FIG. 6A, explaining another ejection signal to be applied to the ink-jet recording head by practicing the ink-jet recording method in accordance with the embodiment of the present invention.
Figures 7A, 7B, 7C, 7D, 7E, 7F:
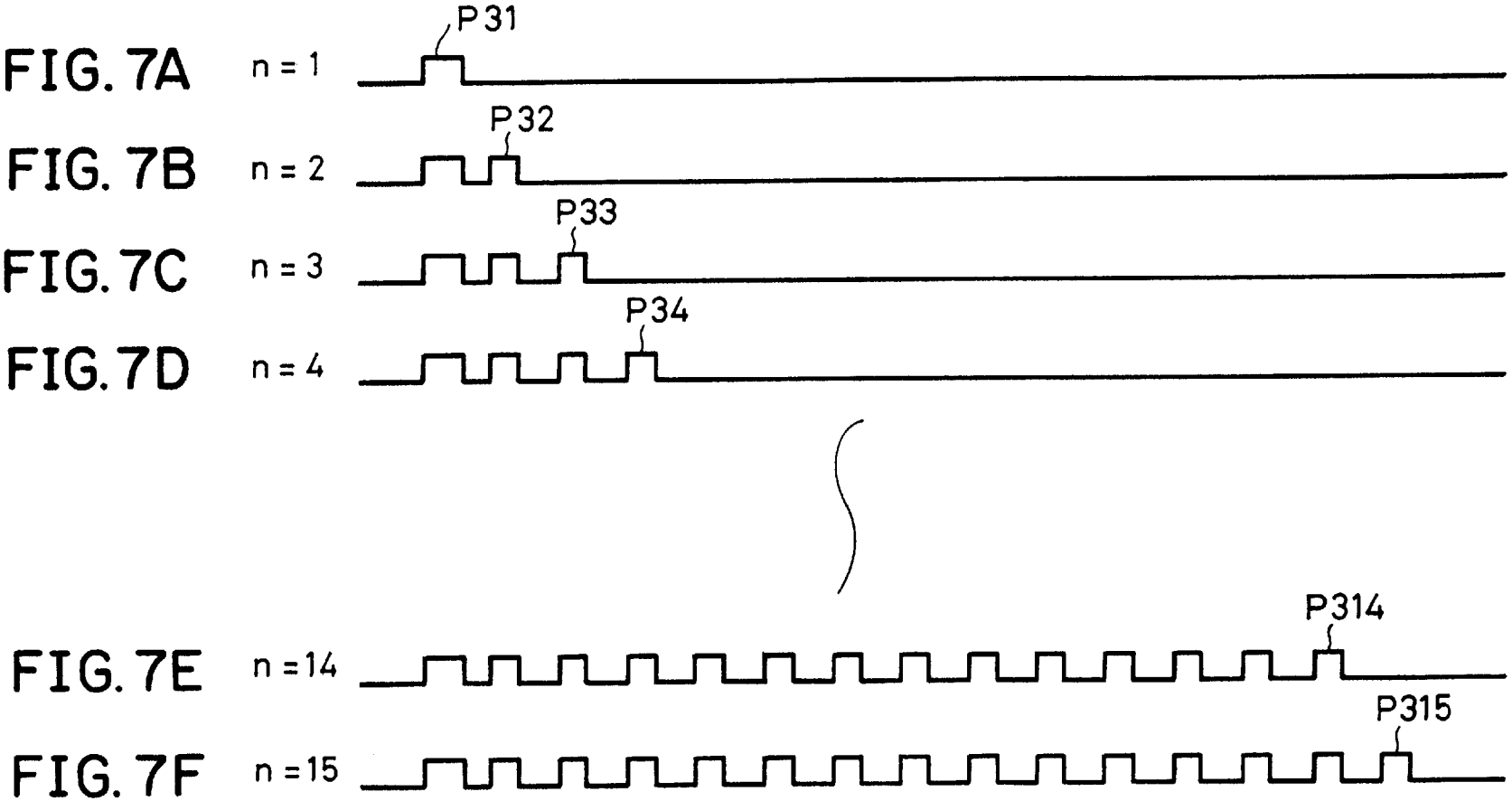
FIGS. 7A–7F comprise an illustrative view which explains a plurality of ejection signals to be applied to the ink-jet recording head by practicing the ink-jet recording method in accordance with the embodiment of the present invention.

FIGS. 7A–7F show by way of example a method of applying ejection signals to the ink-jet recording head by selectively using two kinds of ejection signals P41 and P42 shown in FIG. 6A and FIG. 6B in accordance with the embodiment of the present invention. Here, the ejection signal P41 was generated such that a magnitude of applied voltage was 8.6 V and a pulse width was 2.4 μm, while the ejection signal P42 was generated such that a magnitude of applied voltage was 8.6 V and a pulse width was 3.2 μm. In FIG. 7, n designates the number of liquid droplets which were successively shot onto the recording paper in the overlapping state for forming one pixel therewith. For example, when n is equal to 1, 2, 3 or 4, the number of liquid droplets shot onto the recording paper in the overlapping state to form one pixel therewith is represented by 1, 2, 3 or 4. For example, an ejection signal required for ejecting an n-th liquid droplet among the liquid droplets shot onto the recording paper in the overlapping state to form one pixel therewith when n is equal to 1, 2, 3 or 4 is represented by P31, P32, P33 or P34. The thermal ink-jet recording head used in this embodiment was a multi-nozzle type ink-jet recording head including forty four nozzles. At this time, a minimum pulse width, i.e., a threshold pulse width twth with which liquid droplets started to be ejected when a pulse width tw was increased while a pulse voltage Vh was kept constant was represented by an equation of twth=1.9 μsec under a condition of Vh=8.6 v. On the contrary, pulse widths twth of two ejection signals P41 and P42 shown in FIG. 6A and FIG. 6B were represented by 125% and 168% based on the foregoing threshold pulse width twth of 1.9 μsec, whereby in response to these ejection signals applied to the thermal ink-jet recording head, liquid droplets could continuously be ejected therefrom. A quantity of energy to be fed to the heater in response to the ejection signal P42 was larger than that fed in response to the ejection signal P41.

Figure 8:
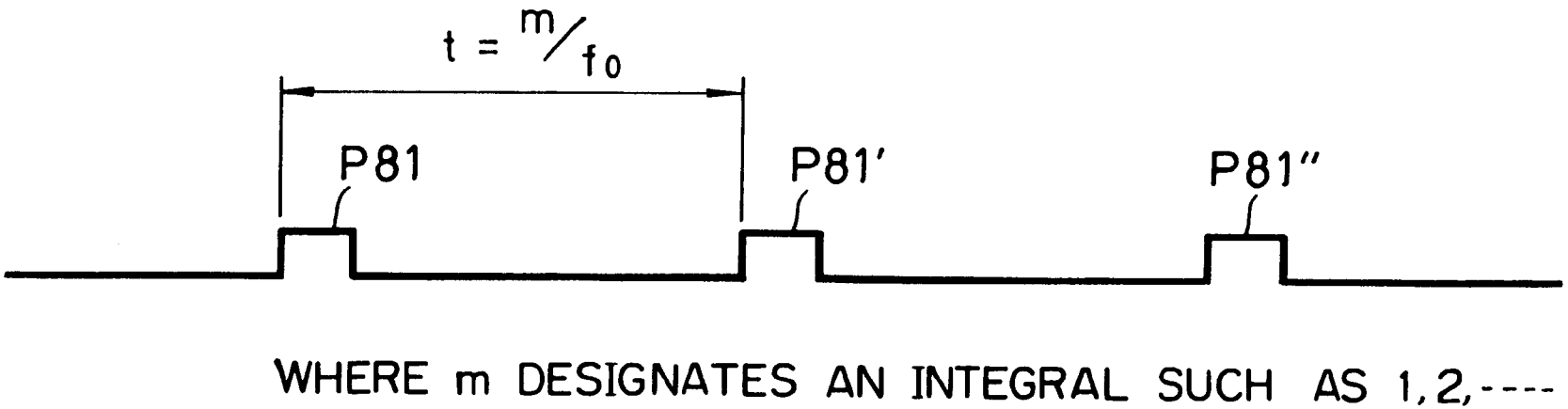
FIG. 8 is an illustrative view which explains a series of ejection signals to be applied to an ink-jet recording head by practicing an ink-jet recording method in accordance with another embodiment of the present invention.

When it is taken into consideration that new ink having a low viscosity is fed from the common liquid chamber into each nozzle as liquid droplets are successively ejected from the ink-jet recording head, the multi-droplet process has a highest level of danger that a malfunction of incorrect ejection occurs with a first liquid droplet among a series of liquid droplets composed of a first liquid droplet, a second liquid droplet and subsequent ones. In other words, it is considered that the case that a malfunction of incorrect ejection occurs at a highest level of danger with the process shown in FIG. 6A and FIG. 6B coincides with the case that only a first liquid droplet is ejected from a same nozzle Ni shown in FIG. 8. In FIG. 8, P81, P81' and P81" designate ejection signals to be applied to the ink-jet recording head at a time interval t represented by m/fo in order to eject a first liquid droplet therefrom, respectively.

In the circumstances as mentioned above, the ejecting state as shown in FIG. 8 was tested with respect to the case that a normal ejecting signal P41 was used like the conventional process when only a first liquid droplet was ejected from the ink-jet recording head under a condition of fo=1.0 kHz (condition 1, FIG. 6A) as well as the case that an ejection signal P42 was used in the same way (condition 2, FIG. 6A), and the results derived from the tests are shown in Table 2. In this case, it was assumed that a time interval of ejecting a No. 1 liquid droplet $t_1$ was set to 1.0 ms.

TABLE 2

| | $t_2$ (sec) | | |
|---|---|---|---|
| | 15 | 30 | 60 |
| condition 1 | Δ | X | — |
| condition 2 | ○ | Δ | Δ |

where $t_2$ represents that a period between the time of ejecting the 1st liquid droplet and the time of suspending the ejection.

In the table, a mark ○ represents the state that ink was ejected from the ink-jet recording head, a mark Δ represents the state that ink was ejected from the same with image deformation, and a mark X represents the state that ink failed to be ejected from the same.

As is apparent from the table, when the ejection signal P42 was applied to the ink-jet recording head under the condition 2, a series of liquid droplets could stably be ejected from the ink-jet recording head for a period of time longer than that in the case that the ejection signal P41 was applied to the same under the condition 1. In other words, when the method of the present invention is employed for the purpose of ejecting liquid droplets, obviously, a series of liquid droplets can reliably be ejected from the ink-jet recording head by feeding a larger quantity of energy to the heater per unit time after each elapse of a predetermined period of time while preventing liquid droplets from failing to be ejected from the same.

It is also thinkable that an ejection signal capable of feeding a large quantity of energy to the heater like at the ejection time P42 during an ejecting operation performed for all liquid droplets is applied to the ink-jet recording head. However, as far as the thermal ink-jet recording head is concerned, when an ejection signal is applied thereto while, e.g., Vh is kept constant and tw is increased, the heater is largely damaged due to the thermal stress appearing in the heater, resulting in the running life of the heater being remarkably shortened. On the contrary, when a method of applying an ejection signal to the ink-jet recording head is employed according to the present invention, a series of liquid droplets are ejected from the ink-jet recording head by feeding a large quantity of energy to the heater during a normal liquid droplet ejecting operation to such an extent that the running life of the heater car be maintained for a predetermined period of time. Thus, since a large quantity of energy is selectively fed to the heater at very small times like the time when a first liquid droplet is ejected from the ink-jet recording head, there does not arise a malfunction that the running life of the heater is remarkably shortened.

As is apparent from the above description, in this embodiment, an excellent quality of image can be obtained by selectively using one of two kinds of ejection signals shown in FIG. 6A and FIG. 6B, i.e., the ejection signal shown in FIG. 6A which assures that a larger quantity of energy can be fed to the heater when a first liquid droplet is ejected from the ink-jet recording head.

In this embodiment, only a first liquid droplet is ejected from the ink-jet recording head by applying the ejection signal P42 to the recording medium so as to allow a larger quantity of energy than that required for achieving a normal ejecting operation to be fed to the heater. However, it is also thinkable that a liquid droplet other than the first liquid droplet, e.g., a second liquid droplet is ejected from the ink-jet recording head corresponding to the compositions of ink and the type of each nozzle under the same conditions as those employed for the ejection of the first liquid droplet.

In this embodiment, two kinds of ejection signals each having a different quantity of energy to be fed to the heater are selectively used in accordance with the order of liquid droplets to overlap one above another. According to the technical concept of the present invention, it is also thinkable that three or more kinds of ejection signals are preliminarily generated in such a manner as to allow them to be applied to the ink-jet recording head, and an ejection signal having a minimum quantity of energy is applied to the ink-jet recording head when at least a first liquid droplet is ejected from the ink-jet recording head.

(Other Embodiments)

In the preceding embodiment, an ejection signal having a total quantity of energy larger than that required during a normal ejecting operation when liquid ejection is restarted is applied to the ink-jet recording head. However, advantageous effects of the present invention can also be obtained by applying to the ink-jet recording head an ejection signal having a quantity of energy to be fed to the ink-jet recording head per unit time larger than that required during a normal ejection operation when liquid ejection is restarted.

Figure 9:
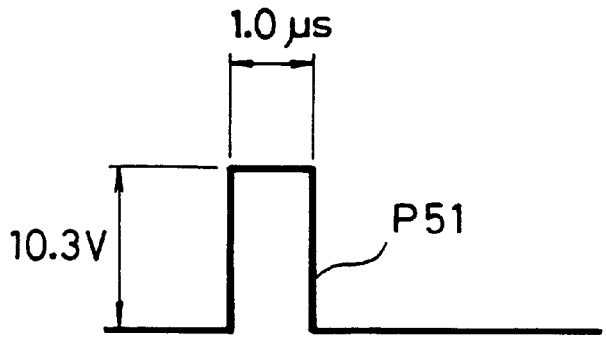
FIG. 9 is an illustrative view which explains another ejection signal to be applied to the ink-jet recording head by practicing the ink-jet recording method in accordance with another embodiment of the present invention.

In the preceding embodiment, the substantially same advantageous effects as those obtainable in the case that the ejection signal P42 was used could also be obtained by applying to the ink-jet recording head an ejection signal P51 having a pulse voltage of 10.3 V and a pulse width of 1.0 $\mu$S, i.e., having a large pulse voltage and a small pulse width tw compared with those of the normal ejection signal P41 as shown in FIG. 9, in place of the ejection signal P42 when liquid ejection was restarted. In other words, in the preceding embodiment, an excellent quality of image could be obtained by selectively using one of two kinds of ejection signals, i.e., an ejection signal having a larger quantity of energy to be fed to the heater per unit time when only a first liquid droplet is ejected from the ink-jet recording head.

In addition, it is also thinkable that an ejection signal having a larger quantity of energy to be fed to the recording head per unit time than that required during a normal ejecting operation as well as a large quantity of energy represented on the total basis is applied to the ink-jet recording head.

Figure 10:
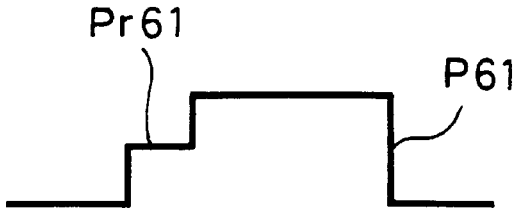
FIG. 10 is an illustrative view which explains an ejection signal to be applied to an ink-jet recording head by practicing an ink-jet recording method in accordance with another embodiment of the present invention.
Figure 11:
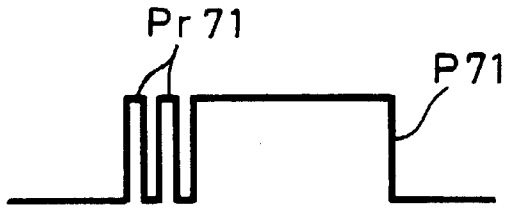
FIG. 11 is an illustrative view similar to FIG. 10, explaining another ejection signal to be applied to the ink-jet recording head by practicing the ink-jet recording method in accordance with another embodiment of the present invention.
Figures 12B, 12C, 12E, 12F:
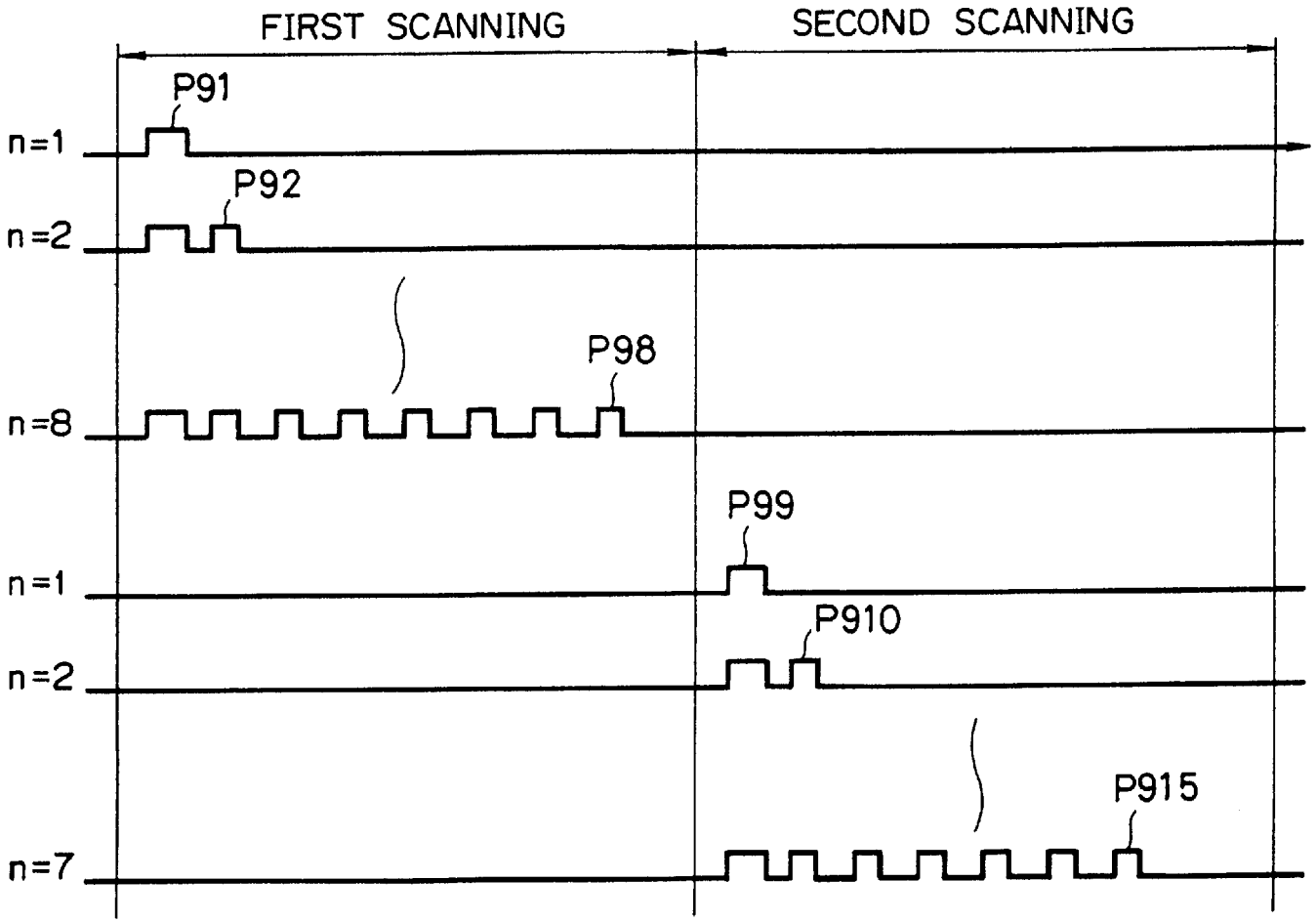

Further, it is also thinkable that a preliminary signal instructing that no liquid droplet is ejected from the ink-jet recording head is applied to the ink-jet recording head ahead of an ejection signal when liquid ejection is restarted. To this end, e.g., ejection signals shown in FIG. 10 and FIG. 11 are substituted for the ejection signal P42 and the ejection signal P51 used in the aforementioned embodiments. In this case, although ejection signals P61 and P72 are signals each of which allows liquid droplet to be ejected from the ink-jet recording head in response to each of the foregoing ejection signals, preliminary signals P61 and P71 are formed adjacent to the ejection signals P61 and P71 in such a manner that energy is fed to the heater to such an extent that no liquid droplet is ejected from the ink-jet recording head when each of the foregoing preliminary signals is applied to the ink-jet recording head. In this connection, it is desirable that the time as counted from the starting of application of each preliminary signal to the ink-jet recording head till the starting of application of each ejection signal to the same directly after the foregoing starting is set to a sufficiently short time compared with the time 1/f, preferably, a time equal to or shorter than several times of a pulse width of each of the ejection signals P61 and P71. As each preliminary signal is applied to the ink-jet recording head, the temperature peripheral to the heater is elevated, and an intensity of power derived from a gas bubble formed on the heater in response to the ejection signal generated directly after the elevation of the foregoing temperature is increased. This makes it possible to acceptably execute liquid ejection when a first liquid droplet is ejected from the ink-jet recording head.

In addition, it is possible to practice the method of the present invention in combination with a so-called multi-scanning method of forming one pixel by ejecting a series of liquid droplets in response to each of scannings performed plural times (as disclosed in official gazettes of Japanese Patent Application Laying-open Nos. 97880/1992 and 358847/1992).

FIGS. 12A–12F comprise an illustrative view similar to FIGS. 7A–7F, schematically showing a multi-scanning method of the type wherein scanning is twice performed in response to application of ejection signals to an ink-jet recording head in such a manner that fifteen liquid droplets in total, i.e., maximum eight liquid droplets counted during first scanning and maximum seven liquid droplets counted during second scanning, are shot onto a recording medium at the substantially same location on the recording medium in accordance with another embodiment of the present invention. In FIG. 12, Ni designates an i-th nozzle on a multi-nozzle type ink-jet recording head. In the embodiment shown in FIG. 12, it is possible to execute excellent liquid ejection by generating ejection signals P91 and P99 in the form of the ejection signal shown in FIG. 6B, and moreover, generating other ejection signals in the form of an ejection signal shown in FIG. 6A.

As is apparent from the description on the aforementioned embodiments, according to the present invention, high reliability in respect of liquid ejection can be obtained without any necessity for a special mechanism even in the case that an ink-jet recording head including small-sized nozzles is used for executing liquid ejection.

In each of the aforementioned embodiments, one pixel is formed with maximum fifteen liquid droplets. However, the present invention should not be limited only to the foregoing number of liquid droplets to overlap one above another. In addition, it is not necessary that a concrete shape representing each ejection signal and a combination of an ejection signal with a preliminary signal is limited only to a pulse-like wave. Moreover, it is not necessary that the combination of an ejection signal with a preliminary signal is limited only to those shown in FIG. 10 and FIG. 11.

The present invention can equally be applied to an ink-jet recording method other than the thermal ink-jet recording method, and this ink-jet recording method can easily be practically realized by any expert in the art.

Since an ink-jet recording apparatus having an ink-jet recording method applied thereto in accordance with the present invention makes it possible to achieve a recording operation not only at a high density but also at a high quality, it can be utilized as outputting means for an information processing system, e.g., a printer serving as an output terminal unit for a copying machine, a facsimile machine, an electronic typewriter, a word processor, a work station and so forth or a handy or portable printer to be equipped in a personal computer, a host computer, an optical disc unit, a video unit and so forth.

As described above, with respect to the ink-jet recording method to be practiced in accordance with the present invention, a plurality of ejection signals is applied to ejecting means in such a manner that at least one of a quantity of energy to be fed to the ejecting means per unit time and a total quantity of energy differs from the other one. In this connection, it is preferable that when a plurality of ink droplets are shot onto a recording medium at the substantially same location on the recording medium, an ejection signal which assures that at least one of a quantity of energy to be fed to ejecting means and a total quantity of energy is maximized is selected from a plurality of ejection signals so as to allow the foregoing signal to be applied to the ejecting means. In addition, it is preferable that a preliminary signal for allowing no ink droplet to be ejected from the ejecting means can be applied to the ejecting means before a plurality of ink droplets are shot onto the recording medium at the substantially same location on the recording medium. With this construction, it is possible to achieve a recording operation with a high quantity of image while preventing the quality of image from being deteriorated.

The present invention has been described above with respect to preferred embodiments thereof, and it should of course be understood that changes and modifications may be made without any departure from the scope of the present invention in its broader aspects, and it is the intention, therefore, in the appended claims to cover all such changes and modifications as fall within the true spirit of the present invention.

What is claimed is:

1. An ink-jet recording method of forming one pixel by ejecting a plurality of ink droplets onto a substantially same place on a recording medium using an ink-jet recording head that includes ejecting means for ejecting ink droplets therefrom, said method comprising the steps of:

controlling a number of ink droplets for forming one pixel according to an image signal; and generating a plurality of ejection signals corresponding in number to the number of ink droplets for forming one pixel with a predetermined ejection signal of said plurality of ejection signals being provided as a specific ejection signal different from other ejection signals of said plurality of ejection signals with respect to at least one selected from an amount of energy per unit time and a total amount of energy; and supplying said plurality of ejection signals to said ejecting means.

2. An ink-jet recording method as claimed in claim 1, wherein when said plurality of ink droplets are ejected onto the recording medium at the substantially same place on the recording medium, a predetermined ejection signal for allowing at least one of a quantity of energy to be fed to said ejecting means per unit time and a total quantity of energy to be maximized is selected from said plurality of ejection signals, and subsequently, the one ejection signal is applied to said ejecting means.

3. An ink-jet recording method as claimed in claim 1, wherein before said plurality of ink droplets are ejected from said ejecting means onto said recording medium at the substantially same place of the recording medium, a preliminary signal for not causing an ink droplet to be ejected from said ejecting means is applied to said ejecting means.

4. An ink-jet recording method as claimed in claim 1, further comprising the step of scanning the ink jet recording head, wherein when one pixel is formed by ejecting said plurality of ink droplets onto said recording medium at the substantially same location on the recording medium, said pixel is formed by the ejection of the liquid droplets while scanning the ink-jet recording head plural times in said scanning step.

5. An ink-jet recording method as claimed in claim 1, wherein said ejecting means comprises an electrothermal transducer for generating thermal energy for causing a phenomenon of film boiling in ink in order to eject the ink therefrom.

6. An ink-jet recording method as claimed in claim 1, wherein said specific ejection signal is applied to said ejecting means prior to the other ejection signals of said plurality of ejection signals.

7. An ink-jet recording apparatus comprising:

a carriage for displacing an ink-jet recording head in a main scanning direction while said ink-jet recording head is mounted thereon, said ink-jet recording head including ejecting means for ejecting ink droplets onto a recording medium so as to allow input image information to be recorded on said recording medium;

a driving unit for generating a plurality of ejection signals for said ink-jet recording head for ejecting said ink droplets from said ink-jet recording head, the plurality of ejection signals corresponding in number to the number of ink droplets for forming one pixel, with a predetermined ejection signal of said plurality of ejection signals being provided as a specific ejection signal different from other ejection signals of said plurality of ejection signals with respect to at least one selected from an amount of energy per unit time and a total amount of energy;

a supply unit for supplying said plurality of ejection signals to said ejecting means; and a controlling unit for controlling operations of said carriage, said ink-jet recording head, said driving unit and said supply unit in order to form one pixel by ejecting a plurality of ink droplets on said recording medium at a substantially same location on the recording medium in response to said plurality of ejection signals, wherein said controlling unit serves to control a number of ink droplets for forming one pixel according to an image signal, and to control said supply unit to supply the plurality of ejection signals.

8. An ink-jet recording apparatus as claimed in claim 7, wherein when said plurality of liquid droplets are ejected from said ejecting means onto said recording medium at the substantially same location of the recording medium, a predetermined ejection signal for allowing at least one of a quantity of energy to be fed to said ejecting means per unit time and a total quantity of energy to be maximized is selected from said plurality of ejection signals, and subsequently, the predetermined ejection signal is applied to said ejecting means.

9. An ink-jet recording apparatus as claimed in claim 7, wherein before said plurality of ink droplets are ejected onto said recording medium at the substantially same place on the recording medium, a preliminary signal for not causing an ink droplet to be ejected from said ejecting means is applied from said driving unit to said ejecting means.

10. An ink-jet recording apparatus as claimed in claim 7, wherein when one pixel is formed by ejecting said plurality of ink droplets onto said recording medium at the substantially same place on the recording medium, said pixel is formed by the ejection of liquid droplets while said carriage scans said ink-jet recording head plural times.

11. An ink-jet recording apparatus as claimed in claim 7, wherein said ejecting means comprises an electrothermal transducer for generating a thermal energy for causing a phenomenon of film boiling in ink to eject the ink therefrom.

12. An ink-jet recording apparatus as claimed in claim 7, wherein said specific ejection signal is applied to said ejecting means prior to the other ejection signals of said plurality of ejection signals.

13. An information processing system including an ink-jet recording apparatus as outputting means, said ink-jet recording apparatus including a carriage for displacing an ink-jet recording head in the main scanning direction while said ink-jet recording head is mounted thereon, said ink-jet recording head including ejecting means for ejecting ink droplets onto a recording medium so as to allow input image information to be recorded on said recording medium, a driving unit for feeding a plurality of ejection signals to said ink-jet recording head when said ink droplets are ejected from said ink-jet recording head, and a controlling unit for controlling operations of said carriage, said ink-jet recording head and said driving unit in order to form one pixel by ejecting a plurality of ink droplets onto said recording medium at the substantially same location on the latter in response to said plurality of ejection signals, wherein said controlling unit serves to generate said plurality of ejection signals in such a manner that at least one of a quantity of energy to be fed to said ejecting means per unit time and a total quantity of energy differs from the other one.

14. An information processing system as claimed in claim 13, wherein when said plurality of liquid droplets are shot onto said recording medium at the substantially same location of the recording medium, an ejection signal for allowing at least one of a quantity of energy to be fed to said ejecting means per unit time and a total quantity of energy to be maximized is selected from said plurality of ejection signals, and subsequently, it is applied to said ejecting means.

15. An information processing system as claimed in claim 13, wherein before said plurality of ink droplets are shot onto said recording medium at the substantially same location on the recording medium, a preliminary signal for allowing no ink droplet to be ejected from said ejecting means is applied to said ejecting means.

16. An information processing system as claimed in claim 13, wherein when one pixel is formed by ejecting said plurality of ink droplets onto said recording medium at the substantially same location on the latter, said pixel is formed by the ejection of liquid droplets executed by performing scanning plural times.

17. An information processing system as claimed in claim 13, wherein said ejecting means is an electrothermal transducer for generating thermal energy required for allowing a phenomenon of film boiling to appear in ink in order to eject ink therefrom.

18. An information processing system as claimed in claim 13, wherein said specific ejection signal is applied to said ejecting means prior to the other ejection signals of said plurality of ejection signals.

* * * * *

UNITED STATES PATENT AND TRADEMARK OFFICE

CERTIFICATE OF CORRECTION

PATENT NO. : 6,394,570 B1
DATED : May 28, 2002
INVENTOR(S) : Inada

It is certified that error appears in the above-identified patent and that said Letters Patent is hereby corrected as shown below:

Column 6,
Line 42, "fo" should read -- f --.

Column 15,
Line 52, "P61 and P71" should read -- Pr61 and Pr71 --.

Column 18, line 65 to Column 19, line 18,
Claim 13 should read as follows:

--13. An information processing system including an ink-jet recording apparatus as outputting means, said ink-jet recording apparatus comprising:

a carriage for displacing an ink-jet recording head in a main scanning direction while said ink-jet recording head is mounted thereon, said ink-jet recording head including ejecting means for ejecting ink droplets onto a recording medium so as to allow input image information to be recorded on said recording medium;

a driving unit for generating a plurality of ejection signals for said ink-jet recording head for ejecting said ink droplets from said ink-jet recording head, the plurality of ejection signals corresponding in number to the number of ink droplets for forming one pixel, with a predetermined ejection signal of said plurality of ejection signals being provided as a specific ejection signal different from other ejection signals of said plurality of ejection signals with respect to at least one selected from an amount of energy per unit time and a total amount of energy;

a supply unit for supplying said plurality of ejection signals to said ejecting means; and a controlling unit for controlling operations of said carriage, said ink-jet recording head, said driving unit and said supply unit in order to form one pixel by ejecting a plurality of ink droplets onto said recording medium at a substantially same location on the recording medium in response to said plurality of ejection signals, wherein said controlling unit serves to control a number of ink droplets for forming one pixel according to an image signal, and to control said supply unit to supply the plurality of ejection signals.--

UNITED STATES PATENT AND TRADEMARK OFFICE

CERTIFICATE OF CORRECTION

PATENT NO. : 6,394,570 B1
DATED : May 28, 2002
INVENTOR(S) : Inada

It is certified that error appears in the above-identified patent and that said Letters Patent is hereby corrected as shown below:

Column 19,
Line 20, "shot" should read -- ejected from said ejection means --.
Line 22, "an" should read -- a predetermined --.

Column 20,
Line 2, "it" should read -- the predetermined ejection signal --.
Line 4, "shot" should read -- ejected --.
Line 7, "allowing no" should read -- not causing an --.
Line 8, "applied" should read -- applied from said driving unit --.
Line 12, "latter," should read -- recording medium, --.
Lines 13-14, "executed by performing scanning" should read -- while said carriage scans said ink-jet recording head --.
Line 16, "is" should read -- comprises --.
Line 17, "required" should be deleted and "allowing" should read -- causing --.
Line 18, "to appear" and "in order" should be deleted.
Line 19, "ink" should read -- the ink --.

Signed and Sealed this

Twenty-third Day of September, 2003

JAMES E. ROGAN
*Director of the United States Patent and Trademark Office*